US007614783B2

(12) United States Patent
Golay

(10) Patent No.: US 7,614,783 B2
(45) Date of Patent: Nov. 10, 2009

(54) CHRONOGRAPH MECHANISM, TIMEPIECE MOVEMENT AND TIMEPIECE COMPRISING SUCH A MECHANISM

(75) Inventor: Jean-Pierre Golay, Sion (CH)

(73) Assignee: Franck Muller Watchland S.A. (CH)

( * ) Notice: Subject to any disclaimer, the term of this patent is extended or adjusted under 35 U.S.C. 154(b) by 0 days.

(21) Appl. No.: 12/337,959

(22) Filed: Dec. 18, 2008

(65) Prior Publication Data

US 2009/0161492 A1 Jun. 25, 2009

(30) Foreign Application Priority Data

Dec. 21, 2007 (CH) ..... 1997/07

(51) Int. Cl.
*G04F 7/00* (2006.01)

(52) U.S. Cl. ..... 368/106; 368/101

(58) Field of Classification Search ..... 368/101, 368/103, 105, 106, 190
See application file for complete search history.

(56) References Cited

U.S. PATENT DOCUMENTS 6,761,478 B2 * 7/2004 Schmiedchen et al. ..... 368/101
7,331,706 B2 * 2/2008 Gabathuler et al. ..... 368/106
7,422,364 B2 * 9/2008 Scheufele ..... 368/106

FOREIGN PATENT DOCUMENTS

EP 0 772 104 B1 5/1997

* cited by examiner

*Primary Examiner*—Truc T Nguyen
*Assistant Examiner*—Jason Collins
(74) *Attorney, Agent, or Firm*—Ostrolenk Faber LLP

(57) ABSTRACT

The invention relates to a chronograph mechanism comprising at least one minutes counter and one hours counter which are designed to be located both on the same side of the plate, first and second resetting members, each having a bearing surface and being able to pivot between a low position, in which each bearing surface cooperates with the periphery of a resetting cam of one of the counters, and a high position, in which each bearing surface is located at a distance from the corresponding cam. The mechanism comprises retaining means for keeping each of the resetting members in its high position, comprising a first retaining member acting directly on a first resetting member and able to be released in response to an action by a user, and a second retaining member acting directly on the second resetting member and able to be released in response to a pivoting of the first resetting member in the direction of its low position.

10 Claims, 3 Drawing Sheets

CHRONOGRAPH MECHANISM, TIMEPIECE MOVEMENT AND TIMEPIECE COMPRISING SUCH A MECHANISM

TECHNICAL FIELD

The present invention relates to a chronograph mechanism for a timepiece movement of the mechanical or automatic type. In particular, the invention relates to such a mechanism which is designed to be mounted on a plate of a timepiece movement having a bridge side and a dial side, comprising a minutes counter and an hours counter which are designed to be located both on the same side of the plate.

The mechanism also comprises first and second resetting members, each having a bearing surface and being designed to be mounted such that they can pivot with reference to the plate between a low position, in which each bearing surface cooperates with the periphery of a resetting cam of one of the counters, and a high position, in which each bearing surface is located at a distance from the corresponding cam. The chronograph mechanism also comprises retaining means for keeping each of the resetting members in its high position, and elastic means arranged so as to cause the resetting members to pivot towards their respective low positions in response to an action by a user aiming to release the retaining means.

PRIOR ART

Such a chronograph mechanism is described for example in the patent EP 0 772 104 B1, granted in the name of Montres Rolex S. A. More particularly, said document discloses the use of three resetting members which are all integral with one another and which are designed to act on a seconds or chronograph counter, a minutes counter and an hours counter. Systems for adjusting the position of this resetting member with triple bearing surfaces are provided for adjusting the action of the bearing surfaces on the cams.

However, despite the presence of these adjustment systems, the adjustment of the position of the resetting member is a very delicate operation and requires great precision in terms of the manufacture of this piece, and also inevitable machining operations during the assembly of the mechanism. This is because it is indispensable that these bearing surfaces are arranged precisely one with respect to the other, on the one hand, and each with respect to the corresponding resetting cam, on the other hand, so that the indicating members driven by the counters return to their initial positions with good precision and in a simultaneous manner.

DISCLOSURE OF THE INVENTION

The main aim of the present invention is to simplify the manufacture and assembly of the resetting members known from the prior art. Additional aims of the present invention are to improve the reliability of the devices of the prior art and in particular to improve the durability thereof over time and in use, in terms of adjustment.

To this end, the present invention relates to a chronograph mechanism of the type mentioned above, characterised in that the retaining means comprise a first retaining member acting directly on a first of the resetting members and able to be released in response to the action by the user, and a second retaining member acting directly on the second of the resetting members in response to a pivoting of the first resetting member in the direction of its low position.

According to one preferred embodiment, the first resetting member pivots about a first axis of rotation, whereas the second resetting member pivots about a second axis of rotation different from the first axis of rotation. The second retaining member is then preferably a lifting lever which is able to pivot about a third axis of rotation, different from the first and second axes of rotation, and which has a first free end arranged so as to cooperate with a control surface of the first resetting member, and a second free end arranged so as to cooperate with a bearing surface of the second resetting member.

Furthermore, it may advantageously be provided that the mechanism comprises a rotary control member, which may be a column wheel, which is arranged so as to turn in a step-by-step manner in response to repeated actions by the user and to have at least one first and one second configurations which are different, with reference to the resetting members. This rotary control member is then arranged in such a way that it is able to act on each of the resetting members so as to cause them to pivot from their respective low positions towards their respective high positions by passing from its first configuration to its second configuration.

The present invention also relates to a timepiece mechanism and a timepiece comprising a mechanism of the type that has just been described.

BRIEF DESCRIPTION OF THE DRAWINGS

Other features and advantages of the invention will become more clearly apparent on reading the following detailed description which is given with reference to the appended drawings given by way of non-limiting examples and in which.

EMBODIMENTS OF THE INVENTION

Figure 1:
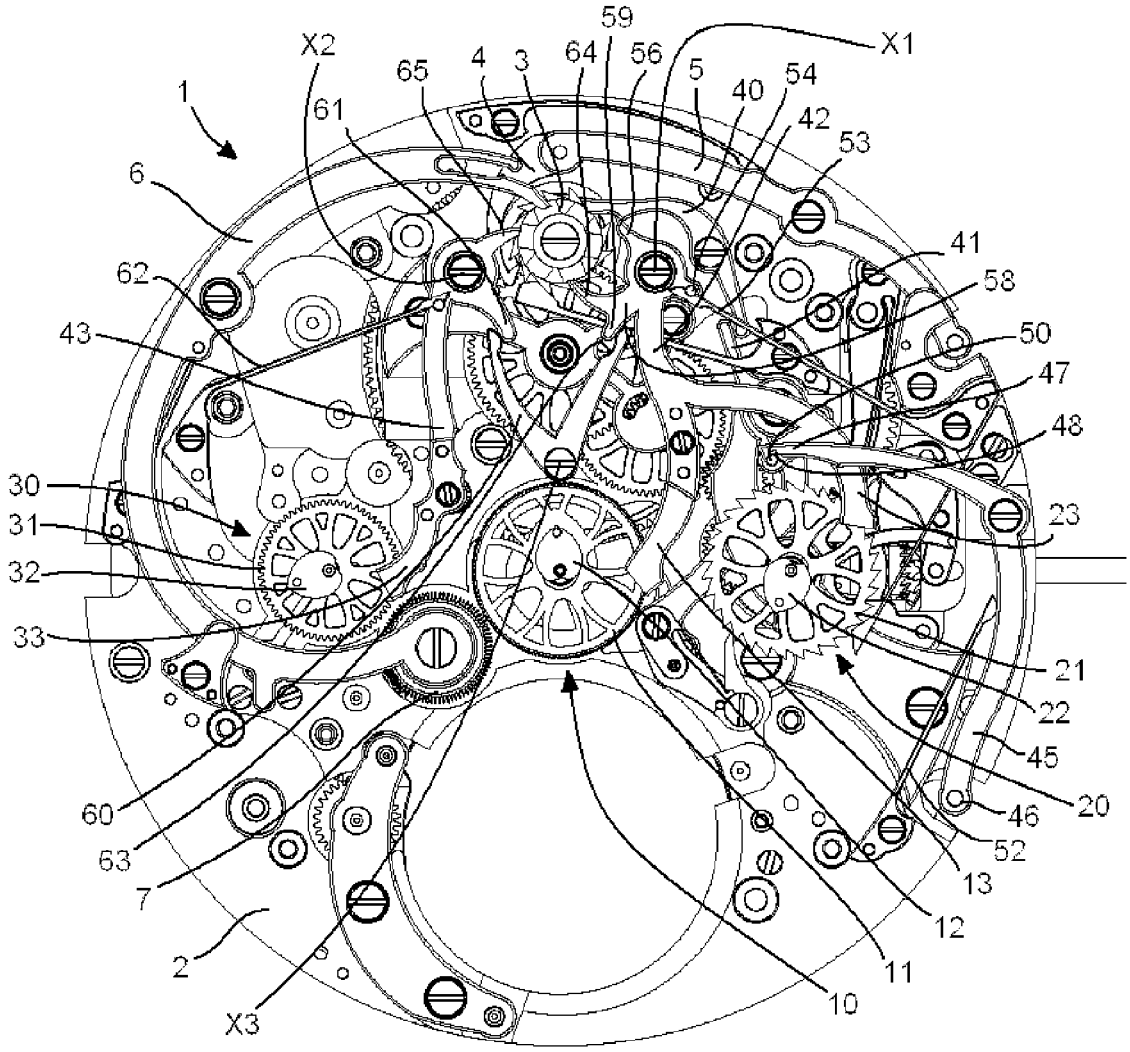
FIG. 1 shows a simplified plan view of a timepiece movement comprising a chronograph mechanism according to one preferred embodiment of the present invention, this being shown in a first configuration.
Figure 2:
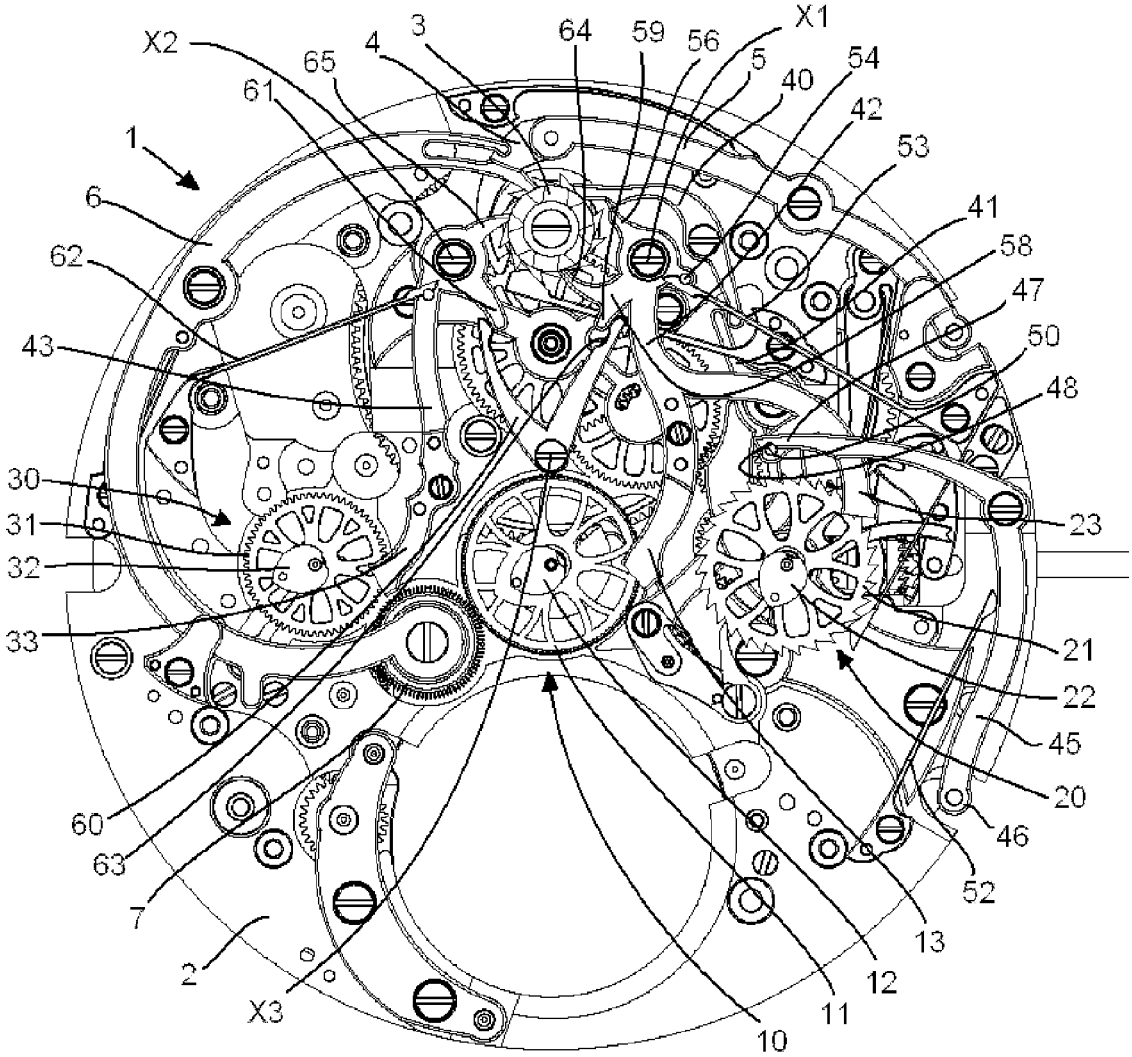
FIG. 2 shows a view similar to that of FIG. 1, the chronograph mechanism being shown in a second configuration.
Figure 3:
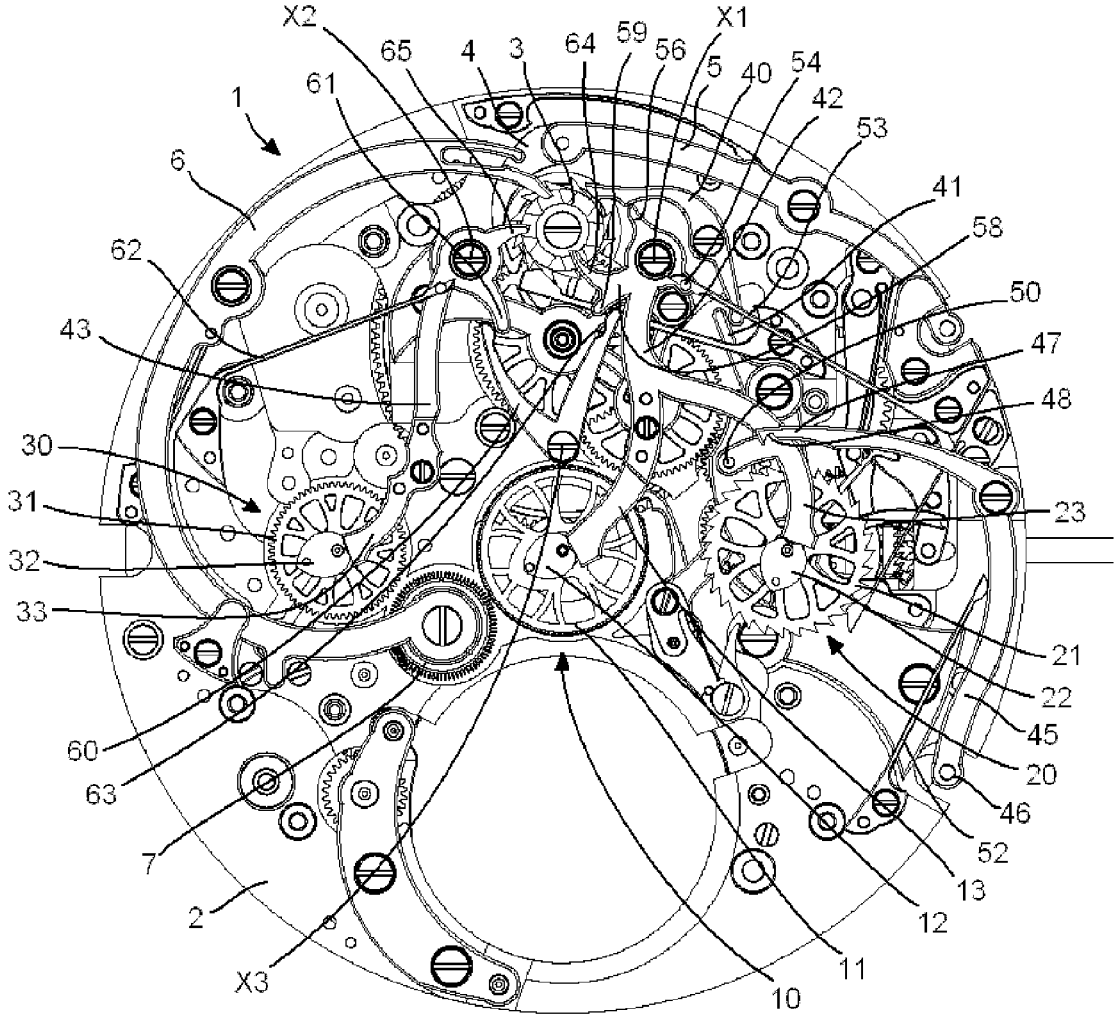
FIG. 3 shows a view similar to that of FIG. 1, the chronograph mechanism being shown in a third configuration.

FIGS. 1 to 3 show simplified plan views, on the dial side, of part of a movement 1 comprising a chronograph mechanism according to the present invention, respectively in a first, a second and a third configuration in which the chronograph is respectively stopped, in operation and reset.

It is obvious that this movement is shown by way of non-limiting example and that the person skilled in the art will be able to implement the subject matter of the present invention by adapting it to a chronograph mechanism arranged on the bridge side, without departing from the scope of the invention.

This movement 1 comprises frame elements, including in particular a plate 2, on which there are mounted moving elements, levers, rockers and other timepiece components, of which only those related to the chronograph mechanism will be described in detail in the present text.

The chronograph mechanism comprises a chronograph counter 10, a minutes counter 20 and an hours counter 30.

Each of these counters comprises a moving element (of which one wheel 11, 21, 31 is visible) designed to be driven in relation to a time base (that of the going train or a time base specific to the chronograph) and is arranged so as to drive in rotation members (not shown) for displaying the measured time.

Each counter also comprises a heart-shaped cam 12, 22, 32 which is integral in rotation with the corresponding display member and is designed to cooperate with resetting members which will be described in detail below.

The chronograph mechanism is of the type comprising a column wheel 3. The latter can be driven in rotation about itself by a hook 4 integral with a control rod 5, the displacements of which can be controlled from a push-button (not shown) in a conventional manner.

Each press on the push-button causes the column wheel 3 to rotate by one step, causing the chronograph function to pass from a stopped state (FIG. 1) to an active state (FIG. 2) and vice versa. To this end, the alternating arrangement of solids (the columns) and voids acts on different rockers so as to active or deactivate functions relating to the measurement of time intervals.

The column wheel cooperates in particular with a clutch lever 6 which carries a clutch setting wheel 7 and which is mounted to pivot on the plate between a first rest position (FIG. 1) and a second drive position (FIG. 2) in which it drives a chronograph train, from a going train (not shown), via the chronograph wheel 11 meshing or not meshing with the clutch setting wheel.

An additional clutch lever (not shown) may be provided for driving the moving hours element 31, for example from the third wheel, whereas the minutes counter 20 is preferably driven from the seconds counter, in a conventional manner.

The column wheel 3 also cooperates with a lever 40 acting on a blocking element 41, the function of which is typically to maintain the angular position of the chronograph wheel 11 when the measurement of a time is interrupted (FIG. 1).

The chronograph mechanism also comprises resetting members which make it possible to position the members for displaying a measured time in their respective rest positions, on demand, when the measurement is interrupted.

The resetting members comprise hammers 13, 23, 33 for resetting the chronograph, minutes and hours counters, the seconds and minutes hammers being integral with the same lever 42 which is mounted to rotate on the plate about a first axis of rotation X1. The hours hammer 33 is carried by a separate lever 43 which is mounted to rotate on the plate about a second axis of rotation X2.

Thus, each of the hammers 13, 23, 33 is able to rotate with reference to the plate between a low position, in which it cooperates with the periphery of the corresponding heart-shaped cam 12, 22, 32, applying a pressure to it, so as to reset the chronograph counters (FIG. 3), and a high position in which it is located at a distance from the heart-shaped cam, which is the case when a measurement of a time interval is in progress or when the chronograph function is simply stopped (FIGS. 2 and 1, respectively).

The resetting members also comprise a resetting control rod 45 which has a first end 46 positioned at four o'clock and designed to cooperate with an external resetting control member (not shown) for lowering the hammers 13 and 23 against the corresponding heart-shaped cams. This control rod 45 has a second end 47 comprising a notch 48 which cooperates with a pin 50 integral with the lever 42.

The function of this notch 48 is to keep or retain the hammers in the high position when a measurement of the time is in progress or simply stopped by the user. A press on the external resetting member, opposing the action of a return spring 52, then has the effect (shown in FIG. 3) of releasing the pin 50 and lowering the hammers 13 and 23 under the effect of the action of a straight spring 53, the free end of which exerts a force on a pin 54 integral with the lever 42 and located close to the axis of rotation X1.

The lever 42 also comprises a first lug 56 arranged so as to cooperate with the lever 40 and to raise the blocking element 41 of the chronograph wheel 11 at the time when the hammer 13 enters into contact with the periphery of the heart-shaped cam 12.

Furthermore, the lever 42 comprises a double lug 58, a first free end 59 of which defines a control surface which cooperates with a retaining member in the high position of the hammer 33 of the hours counter. This retaining member is a lifting lever 60 which is substantially V-shaped and is mounted to rotate on the plate about a third axis of rotation X3.

While it cooperates with the free end 59 of the double lug 58 by a first of its two branches, the lifting lever also cooperates with a lug 61 of the lever 43, defining a bearing surface, by its second branch so as to keep the hammer 33 of the hours counter in the high position when the hammers 13, 23 of the chronograph and minutes counters are in the high position.

Thus, when the resetting is not actuated (FIGS. 1 and 2), the lifting lever 60 opposes the force of a return spring 62 acting on the lever 43 so as to cause the hammer 33 to rotate in the direction of its low position. When the hammers 13 and 23 descend, they release the lifting lever, which in turn releases the lever 43, driven towards the low position of the hammer 33 under the effect of the force exerted by the return spring 62.

It will be noted that the lifting lever has a small concavity 63 formed in its first branch so as to improve the stability of the retaining position and also the fluidity of the kinematics involved during a resetting operation.

Furthermore, the double lug 58 of the lever 42 has a second free end 64 which is arranged so as to cooperate with the columns of the column wheel 3. Likewise, the lever 43 has a second lug 65 which is also designed to cooperate with the columns of the column wheel 3.

In the configuration shown in FIG. 2, that is to say when a measurement is in progress, one column is located opposite the free end 64 and another column is located opposite the lug 65. Consequently, the resetting cannot be activated since the hammers are locked in the high position by the column wheel. When the chronograph is stopped by rotating the column wheel 3 by one step (FIG. 1), voids of the column wheel are positioned opposite the free end 64 and the lug 65. Only the retaining members of the resetting means then keep the hammers in the high position.

A press on the external resetting member causes the release of the lever 42 which releases the lever 43 via the lifting lever 60, so as to reset the counters of the chronograph.

Another press on the push-button acting on the control rod 5 has the effect of causing the rotation of the column wheel 3, a first column of which then raises the lever 42, via the free end 64, and the lever 43, via the lug 65, until the pin 50 repositions itself inside the notch 48. The hammers 13, 23, 33 are then again locked in the high position by the retaining means. At the same time, the first free end 59 of the double lug 58 repositions itself in the concavity 63 of the lifting lever 60 which follows the movement of the lever 42.

It is clearly apparent from the above that the lifting lever 60 advantageously makes it possible to provide two separate levers for acting on the different chronograph counters, which results not only in greater flexibility in terms of the design of the chronograph mechanism, in particular with regard to the choice of installation location of the counters, but also simplifies the assembly thereof. This is because each of the levers with its resetting hammer(s) can be adjusted independently of the other with reference to the position of the associated heart-shaped cams.

The above description describes one particular embodiment by way of non-limiting example, and the invention is not limited for example to using an integrated chronograph mechanism but could also be used in relation to a chronograph mechanism of the modular type. Similarly, the person skilled in the art could for example adapt the above teaching to the implementation of a "flyback"-type mechanism, without departing from the scope of the present invention. The invention is also not limited to the design shown in relation to the driving of the different chronograph counters, and the person skilled in the art will be able to provide variants more suited to his own requirements.

The invention claimed is:

1. Chronograph mechanism which is designed to be mounted on a plate of a timepiece movement having a bridge side and a dial side, the mechanism comprising a minutes counter and an hours counter which are designed to be located both on the same side of the plate, first and second resetting members, each having a bearing surface and being designed to be mounted such that they can pivot with reference to the plate between a low position, in which each bearing surface cooperates with the periphery of a resetting cam of one of said counters, and a high position, in which each bearing surface is located at a distance from said corresponding cam, retaining means for keeping each of said resetting members in its high position, elastic means arranged so as to cause said resetting members to pivot towards their respective low positions in response to an action by a user aiming to release said retaining means, wherein said retaining means comprise a first retaining member acting directly on a first of said resetting members and able to be released in response to the action by the user, and a second retaining member acting directly on the second of said resetting members and able to be released in response to a pivoting of said first resetting member in the direction of its low position.

2. Mechanism according to claim 1, wherein said first resetting member pivots about a first axis of rotation (X1), whereas said second resetting member pivots about a second axis of rotation (X2) different from said first axis of rotation.

3. Mechanism according to claim 2, wherein said second retaining member is a lifting lever which is able to pivot about a third axis of rotation (X3), different from said first and second axes of rotation (X1, X2), and which has a first free end arranged so as to cooperate with a control surface of said first resetting member, and a second free end arranged so as to cooperate with a bearing surface of said second resetting member.

4. Mechanism according to claim 1, wherein it also comprises a rotary control member which is arranged so as to turn in a step-by-step manner in response to repeated actions by the user and to have at least one first and one second configurations which are different, with reference to said resetting members, said rotary control member being arranged in such a way that it is able to act on each of said resetting members so as to cause them to pivot from their respective low positions towards their respective high positions by passing from said first configuration to said second configuration.

5. Mechanism according to claim 4, wherein said rotary control member is a column wheel comprising a plurality of columns capable of cooperating with a first lug of said first resetting member and with a second lug of said second resetting member.

6. Mechanism according to claim 5, wherein each of said first and second lugs is arranged between two of said columns when said first and second resetting members are in their respective low positions.

7. Timepiece comprising a casing which houses a chronograph mechanism according to claim 4 and which has a first external control member arranged so as to control the rotational movements of said rotary control member and also a second external control member arranged so as to release said retaining means.

8. Mechanism according to claim 1, wherein it is integrated in a timepiece movement.

9. Timepiece movement comprising a going train which is designed to drive a chronograph mechanism according to claim 1.

10. Timepiece comprising a casing which houses a chronograph mechanism according to claim 1.

* * * * *